US006550960B2

(12) United States Patent
Catalfamo et al.

(10) Patent No.: US 6,550,960 B2
(45) Date of Patent: Apr. 22, 2003

(54) APPARATUS FOR IN-LINE MIXING AND PROCESS OF MAKING SUCH APPARATUS

(75) Inventors: Vincenzo Catalfamo, Cincinnati, OH (US); Gina Lynn Blum, Mt. Healthy, OH (US); Shaffiq Amin Jaffer, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/911,774

(22) Filed: Jul. 24, 2001

(65) Prior Publication Data

US 2002/0064087 A1 May 30, 2002

Related U.S. Application Data

(60) Provisional application No. 60/239,615, filed on Oct. 11, 2000.

(51) Int. Cl.[7] ..... B01F 5/06
(52) U.S. Cl. ..... 366/337
(58) Field of Search ..... 366/336, 337, 366/340

(56) References Cited

U.S. PATENT DOCUMENTS

| | | | | | |
|---|---|---|---|---|---|
| 3,918,688 | A | * | 11/1975 | Huber et al. | 366/336 |
| 3,946,994 | A | | 3/1976 | Mertz et al. | |
| 4,019,719 | A | * | 4/1977 | Schuster et al. | 366/338 |
| 4,057,224 | A | * | 11/1977 | Muller et al. | 366/336 |
| 4,062,524 | A | * | 12/1977 | Brauner et al. | 366/340 |
| 4,093,188 | A | * | 6/1978 | Horner | 366/337 |
| 4,296,779 | A | * | 10/1981 | Smick | 366/337 |
| 4,535,551 | A | | 8/1985 | Groeneveld et al. | |
| 4,731,229 | A | * | 3/1988 | Sperandio | 366/336 |
| 4,744,928 | A | * | 5/1988 | Meier | 366/337 |
| 4,844,620 | A | | 7/1989 | Lissant et al. | |
| 5,063,000 | A | * | 11/1991 | Mix | 366/337 |
| 5,268,224 | A | | 12/1993 | DesMarais et al. | |
| 5,484,203 | A | * | 1/1996 | King et al. | 366/337 |
| 5,492,408 | A | * | 2/1996 | Alfare | 366/337 |
| 5,605,399 | A | * | 2/1997 | King | 366/337 |
| 5,620,252 | A | * | 4/1997 | Maurer | 366/337 |
| 5,795,732 | A | | 8/1998 | Schilling et al. | |
| 5,971,603 | A | * | 10/1999 | Davis et al. | 366/337 |

FOREIGN PATENT DOCUMENTS

DE 31 02 317 A 8/1982

OTHER PUBLICATIONS

Stichlmair, J., "Ullmann's Encyclopedia of Industrial Chemistry, vol. B3: Unit Operations II", 1988, VCH Verlagsgesellschaft MBH, Weinheim, Germany XP002190616, p. 4–82, col. 2, line 33–47—p. 4–84, col. 1; figure 81; table 3.

* cited by examiner

*Primary Examiner*—Tony G. Soohoo
(74) *Attorney, Agent, or Firm*—Larry L. Huston; Ian S. Robinson; Leonard W. Lewis

(57) ABSTRACT

A static mixer having one or more stages and/or elements. The static mixer may be scaled from bench size to any commercially desired size. During scale-up the surface area to void volume ratio is maintained constant. Maintaining this ratio constant may be accomplished by increasing the number of bars in each element of the static mixer.

14 Claims, 4 Drawing Sheets

APPARATUS FOR IN-LINE MIXING AND PROCESS OF MAKING SUCH APPARATUS

This non-provisional patent application claims priority to a provisional application, Ser. No. 60/239,615, filed on Oct. 11, 2000 having the title "Apparatus For In-Line Preparation Of Emulsions" and listing the inventors as "Vincenzo (nmn) Catalfamo, Gina Lynn Blum, and Shaffiq Amin Jaffer".

FIELD OF INVENTION

This invention relates to an apparatus for the mixing of streams of fluids, including liquids and gases, insertable in a pipe of any cross section in which stationary mixing elements are used.

BACKGROUND OF INVENTION

Mixing of two or more different substances is useful in many industrial applications. The substances may be any combination of solids, liquids and/or gasses. The substances may be miscible where mixing produces a single phase blend or immiscible, yielding a dual phase emulsion. A liquid—liquid emulsion is a dispersion of one liquid phase in another substantially immiscible continuous liquid phase. A gas-liquid dispersion is a dispersion of an insoluble or partially soluble gas into a liquid.

The art has typically used dynamic mixers employing axially rotating elements for the production of emulsions. By their very nature rotating elements such bars, pins, paddles, and the like do not have a uniform tangential speed. Consequently, when a fluid, flowing in the axial direction, encounters an element rotating an angle to the axis, typically perpendicular thereto, more shear will be imparted at the outer radius of the rotating element than at the center of rotation. This difference in applied shear makes preparation of uniform emulsions difficult because more than optimal shear may be imparted at the outer radius while less than optimal shear may be imparted near the center of rotation. Further, the differences in applied shear have different effects on the resulting emulsion, depending on the size of the rotating element. Such differences make scale-up difficult. Further, dynamic mixers require significantly greater energy input than static mixers, potentially jeopardizing the economics of operation.

For production of gas-liquid dispersions, liquid—liquid emulsions, and other mixtures the art has typically used static mixers to provide the shear and elongation necessary to disperse the discrete phase throughout the continuous phase. See, for example, U.S. Pat. No. 3,918,688 issued to Huber et al. on Nov. 11, 1975 incorporated herein by reference and U.S. Pat. No. 5,971,603 issued to Davis. et al. on Oct. 26, 1999, respectively. U.S. Pat. No. 4,019,719, issued to Schuster et al. on Apr. 26, 1977, and U.S. Pat. No. 4,062,524 issued to Brauner et al. on Dec. 13, 1977, both incorporated herein by reference, respectively describe an apparatus for thoroughly mixing components of fluid material through a tube-like conduit which contains a plurality of consecutive mixing elements comprising a set of stationary, angularly disposed flow deflecting baffles and an apparatus having a pipe with pairs of comb like plates arranged so that webs of one plate extend cross wise to the slots of the other.

In static mixers fluid flows past fixed elements is divided, stretched, folded and recombined by an arrangement of elements to provide mixing of all the substances present. A bar is an individual member which divides the flow. An element is an arrangement of bars, typically held mutually parallel, at any cross section in the flow path. Typically a static mixer may have from five to 30 elements, with as few as two elements being used for turbulent flow applications.

Prior art static mixers have also used steel wool for the internal elements, instead of the discrete bars described above. Steel wool has no fixed geometry. Variations in the density of the steel wool cause similar variations in the precision of the process in which such a static mixer is used. Further, portions of the steel wool may break off and be washed downstream. Prior art static mixers have also used corrugated sheets for the internal elements, instead of the discrete bars described above. Corrugated sheets have not been found to yield the tight particle size distribution sought by the end users of static mixers. Prior art static mixers have also used superimposed mesh screens, instead of the discrete bars described above. Mesh screens must be woven, increasing the fabrication cost and have the disadvantage of weak internals that may break, contaminating the process.

Frequently a commercial scale static mixer is derived from a bench scale static mixer which has proven suitable. Scale up for static mixers has attempted to hold constant shear rate and residence time in laminar flow applications and power per unit volume in turbulent flow applications. Thus, scale up from bench scale to commercial scale was usually done by holding the number of stages and bars constant while increasing the cross sectional area of the pipe or other flow channel.

In lieu of scale up, the art has utilized parallel processing to mix streams of fluids with multiple small mixers physically grouped together in order to increase scale of production, such that comparable product quality is achieved at various scales. Such "grouping" designs pose difficulties for process control and reliability. For example, proper dosage of individual streams into each individual parallel mixer conduit is difficult to achieve. Moreover, the use of parallel systems (on the order of hundreds for large commercial scales) is impractical and costly.

Improvements in the method of reliably producing such mixtures, dispersions, and emulsions at a range of scales are needed. It is difficult to predictably scale mixers from a laboratory scale or pilot scale to a full production scale. Simply increasing the size of a static mixer to increase production capability (even if some process parameters, such as shear rate are matched) does not necessarily result in an dispersion/emulsion having the same properties as produced using a smaller scale static mixer.

SUMMARY OF THE INVENTION

In accordance with a first aspect of the present invention, a method for and static mixer for mixing two or more miscible or immiscible substances is provided. The method comprises the steps of providing a first phase and a second phase the ratio of said first phase to said second phase being between about 1:1000 and about 250:1; combining the first and second substances to provide a mixed process stream; using at least one static mixer in a single pass so as to provide sufficient surface area and residence time to mix the substances. In another aspect of the invention, a pilot or laboratory size static mixer is scaled to commercial size while holding constant the ratio of active surface area to void volume.

DETAILED DESCRIPTION OF THE INVENTION

I. Useful Components Mixable by the Static Mixer

The system and process of the present invention may be used in preparing miscible and immiscible mixtures of at least two phases, including without limitation mixtures having a relatively high ratio of one phase to the other. For example, water-in-oil high internal phase emulsions can be formulated to have a relatively wide range of internal to external (e.g. dispersed to continuous) phase ratios. Also, the system and process of the present invention may be used in preparing oil-in-water mixtures, such as latexes and the like. Furthermore, the system and process of the present invention may be used in preparing mixtures of first and second phases having a relatively low ratio of an internal phase to a continuous external phase. It is also within the scope of the present invention that the fluid includes gasses as well as liquids. Furthermore, thixotropic, shear thinning and other non-Newtonian fluids are included within the meaning of the term fluid.

In one embodiment of the process of the present invention the ratio of first phase to second phase may be from about 1:1000 to about 250:1 and is typically from about 1:750 to about 250: 1, more typically from about 1:500 to about 200:1, even more typically from about 1:250 to about 200:1, and most typically from about 1:150 to about 150:1.

In one embodiment of the present invention, one fluid may comprise a variety of oily materials. Various oily materials comprising straight, branched and/or cyclic paraffins such as mineral oils, petroleums, $C_{16}$ to $C_{18}$ fatty alcohol di-isootanoates, resin oils, wood distillates, petroleum based products such as gasolines, naphthas, lubricating and heavier oils and coal distillates. The oily material may comprise a monomer, co-monomer, or other polymerizable material, such as crosslinking agents, polymers, etc. Examples of suitable monomers for this embodiment of the present invention, include, but are not limited to, monoenes such as the ($C_4$–$C_{14}$) alkyl acrylates, the ($C_6$–$C_{16}$) alkyl methacrylates, ($C_4$–$C_{12}$) alkyl styrenes and mixtures thereof.

In one embodiment, one of the phases may comprise an aqueous system, which optionally, may comprise one or more dissolved components such as a water-soluble electrolyte. The dissolved electrolyte minimizes the tendency of any components in the other phase to also dissolve in the water phase. If the product is used to make polymeric material, a polymerization initiator such as peroxygen compounds and conventional redox initiator systems may be included in the water phase. The present invention also allows for the optional addition of ingredients that are not necessarily a component of the mixture itself. Examples include solid materials, such as powders, pigments, fillers, fibers, etc.

II. Apparatus, Process of Making and Process Employing the Apparatus

Figure 1:
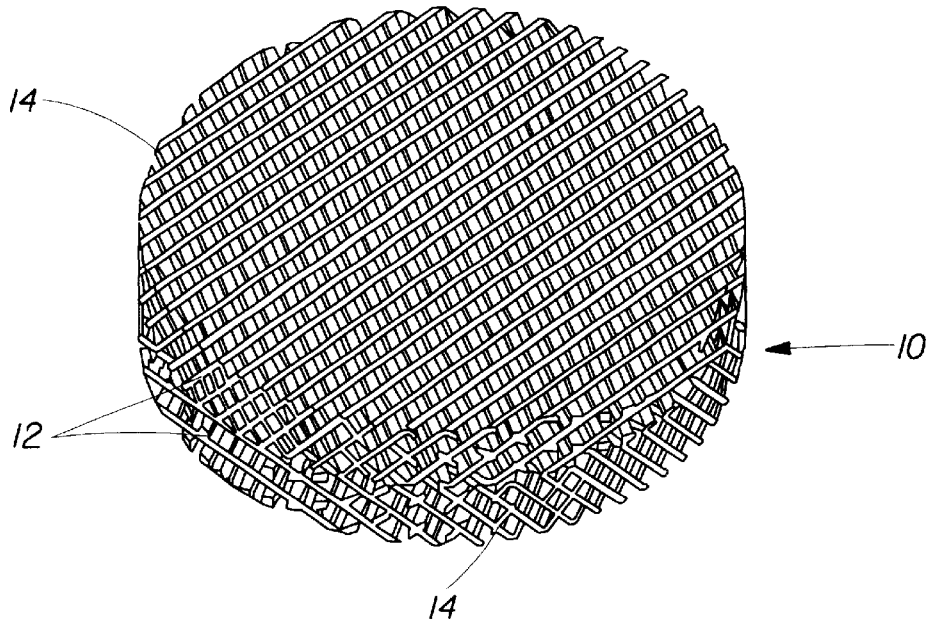
FIG. 1 is a schematic perspective view of a two element static mixer in accordance with one embodiment of this invention.
Figure 2:
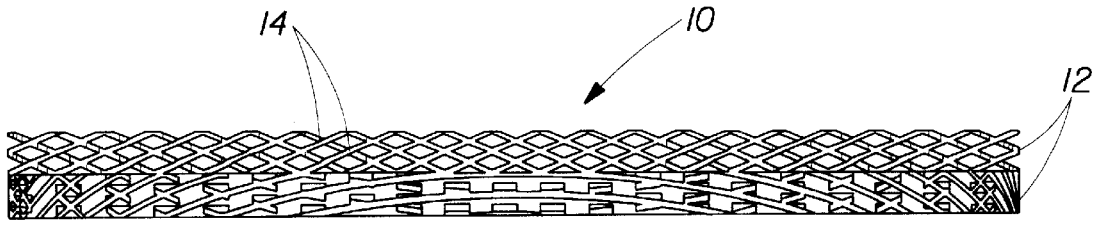
FIG. 2 is a side elevational view of the static mixer of FIG. 1.

Referring to FIGS. 1–2 static mixers 10, according to the present invention, placed in a flow, will impart a relatively uniform shear along their length, as permitted by the velocity cross section. As used herein, a "static mixer" 10 is an assembly of one or more stages that mixes or blends materials flowing through a flow conduit by subdividing and recombining the flow. A "stage" is an assembly of "elements" 12 inserted in the flow conduit. An "element" 12 is an assembly of bars 14, each bar 14 dividing the flow into at least two streams that are combined with separate streams and mixed together. The "bar" 14 is the portion of the static mixer 10 that interrupts and divides the fluid flow.

The bars 14 in each element 12 are discrete, optionally parallel, and have a fixed and predetermined geometry. Inside a static mixer 10, fluids flow in a conduit past the stationary bars 14. The bars 14 are arranged generally in the same direction as the flow of fluid. Consequently, the relative velocities of the fluids may be relatively constant across the cross section of the flow. Because such relative velocities are relatively constant, static mixers 10 can be predictably sized according to production needs. The static mixer 10 may be relatively short in the flow direction, not cause excessive pressure losses and yet ensure sufficient homogenization.

FIGS. 1–2 show a two element 12 static mixer 10 usable alone or with a series of stages or other elements 12. The bars 14 may be oriented to one another from 0 to 180 degrees within the plane of the cross section of the flow, wherein FIG. 2 shows a particular orientation of the first bars 14 disposed 90 degrees to the second bars 14. Each element 12 is constructed in a lattice framework of bars 14 inclined at an angle of 45 degrees relative to the flow direction, although orientations from 0 to 180 degrees may be suitable. The bars 14 are oriented in a periodic manner wherein adjacent bars 14 intersect within the plane of the cross section from 0 to 180 degrees. This geometry creates channels for the discrete and/or continuous phase/mixture to flow through whereby the surface of the bars 14 is wetted.

Additionally, it is desirable that the bars 14 of the static mixer have a particular angular orientation relative to the flow direction. The proper angular orientation provides a suitable amount of shear to the two phases being mixed and can be found using methods well known in the art and which will not be repeated here. For the embodiments described and claimed herein, a bar 14 orientation of 0 to 90, typically 30 to 60 and more typically 45 degrees relative to the flow direction has been found suitable.

The static mixer 10 has a perimeter which is closely matched the inside dimensions of the pipe, duct or other flow channel into which the static mixer 10 is inserted. While a static mixer 10 having a round perimeter is illustrated, one of skill will realize the invention is not so limited. Any cross-sectional shape having a reasonable hydraulic radius may be used. The static mixer 10 has a total cross sectional area internal to the perimeter, and which is comprised of flow channels and bars. The total cross sectional area of a static mixer is found using simple geometry not repeated here.

The surface properties of the elements 12 are chosen such that at least one phase preferentially wets this surface. The elements 12 may be constructed of or coated with steel, aluminum, TEFLON™, polypropylene, etc. The ends of the bars 14 come to a common intersection, which may be flat, rounded, or have a sharp edge. The cross sections of the bar 14 may have a particular cross-section, such as triangular, curved, parallelagram, drop-shaped or elliptical.

In one embodiment of the present invention there may be premixing of the fluids prior to entry into the static mixer. This helps insure that portions of both streams are juxtaposed across the cross section of the flow conduit. Here, the fluids are in separate streams. Initially, the streams only experience shear forces very near the bars 14. The brief period of turbulent mixing between the confluence where the streams are combined and the entry into the first static mixer 10 provides an initial distribution of both streams across the cross section of the flow conduit so that the streams are more readily subdivided and mixed with each other.

Within the static mixer 10, it is desirable that the two phases/materials encounter a minimum residence time as separate phases, although the total residence time in the static mixer 10 should be sufficient to ensure adequate mixing.

According to this invention, the problem of producing comparable emulsion at various scales is reduced or substantially solved by preferably holding the ratio of Q/Es constant. That is:

$Q/Es=K$ where:

Q is the volumetric flow rate (any appropriate units, e.g. $m^3/s$),

Es is the "active" mixer surface i.e., the element 12 surface that is directly exposed to the flow (any appropriate units, e.g. $m^2$), and K is a constant.

Q/Es represents a constant parameter across scales. By keeping Q/Es constant at different scales, the average fluid velocity within the static mixer 10 remains constant as well. Constant mixer velocity and mixer constant geometry ensure constant shear rate and energy dissipation distributions across various sizes of static mixers, thus ensuring scaling will be successful. As used herein, scaling refers to the process of changing the size of a static mixer, to accommodate a greater (scale-up) or lesser (scale-down) flow volume. Typically scaling involves a change in the size, but not the shape of the perimeter of the static mixer.

Typically commercially sized static mixers are made by first developing a suitable bench scale static mixer. As used herein, a bench scale static mixer 10 refers to a static mixer 10 having a size amenable to being developed using bench scale equipment. A typical bench scale static mixer 10 is developed using a round pipe having a diameter of approximately 6 mm. The bench scale static mixer 10 is often used to determine the number of elements, stages, orientation and number of the bars 14, etc. In the prior art, such a mixer is then scaled to commercial size by maintaining the number of bars 14 constant and letting the aforementioned flow through surface area to void volume ratio float. A commercial size static mixer 10 refers to a static mixer 10 having a size suitable for the volume of material intended to be processed and the operating conditions experienced during service. Typically but not necessarily the commercial size static mixer 10 will be larger than the bench scale mixer. The commercial size mixer may be several orders of magnitude larger than the bench scale mixer, using the scaling process of the present invention.

According to the present invention, a bench scale static mixer 10 is designed as done by one of ordinary skill using methods not repeated here. The static mixer 10 of the present invention may have the geometry of FIGS. 1–2. In contrast to the prior art, the static mixer 10 according to the present invention is scaled by maintaining the geometry of FIGS. 1–2 and ensuring that the ratio of Q/Es is equivalent for static mixers of any scale, as noted above.

Figure 3A:
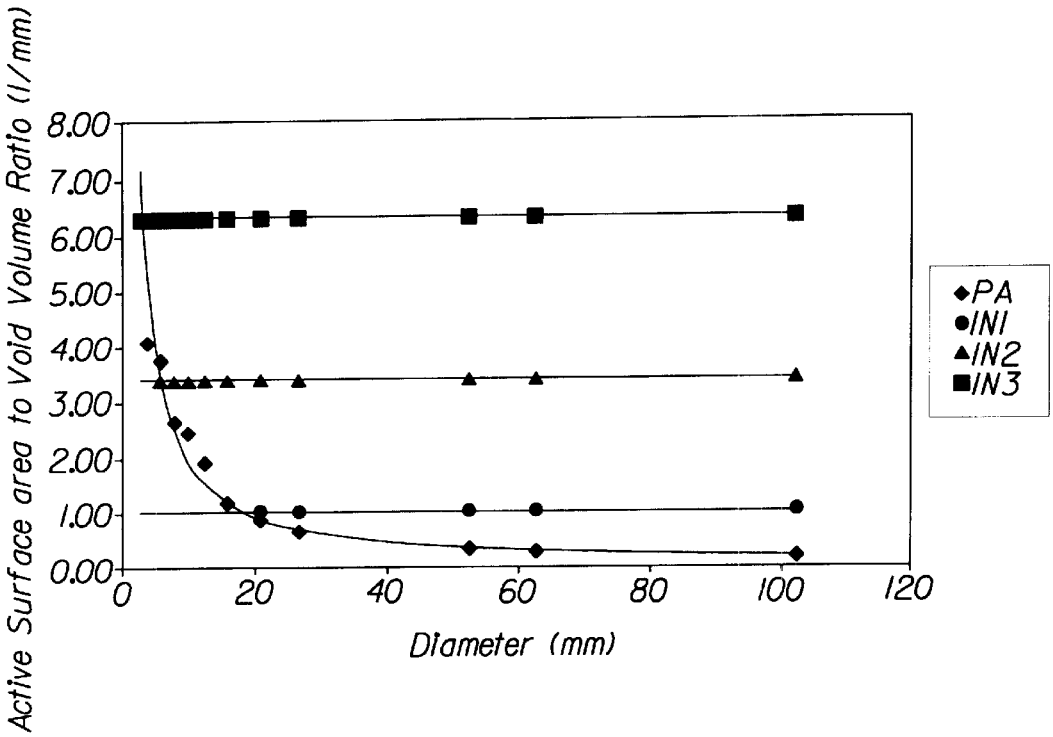
FIG. 3A is a graphical representation of static mixer scale-up, showing a constant active surface area to void volume ratio for the illustrated embodiments of the present invention and a declining ratio for the prior art.
Figure 3B:
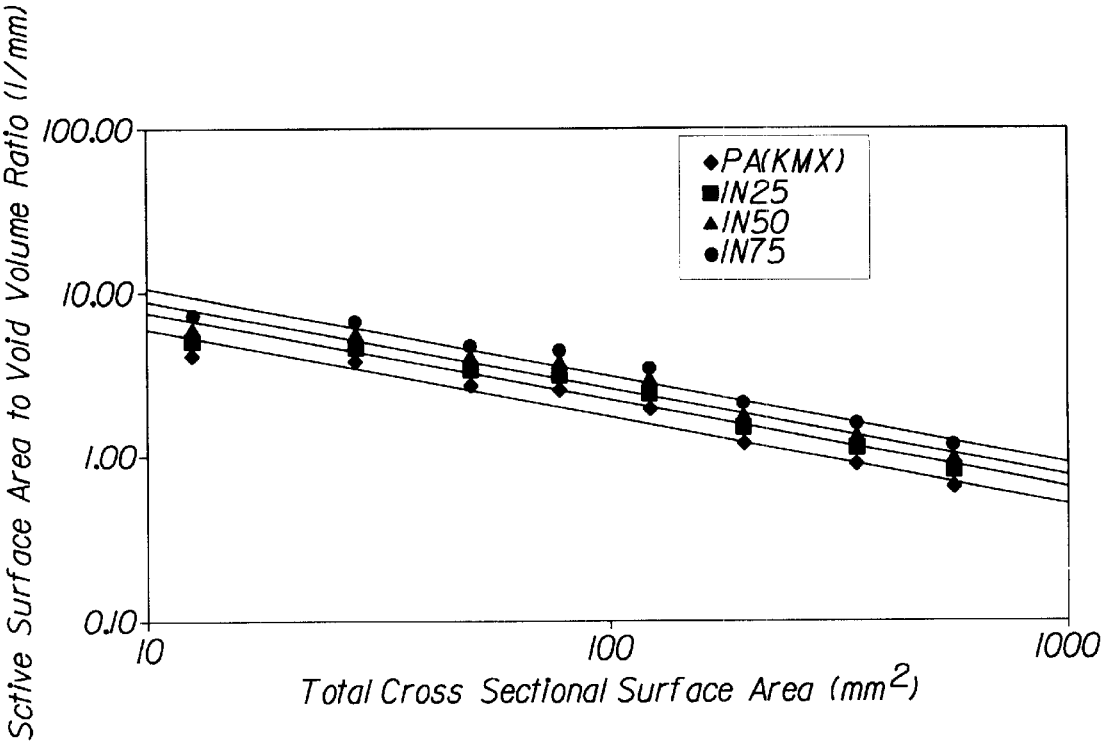
FIG. 3B is a log log scale graphical representation of the prior art shown in FIG. 3A and further illustrating three graphical representations of static mixers according to the present invention.

To maintain the desired geometry and surface area to void volume ratio during scale-up the number of bars 14 is allowed to float—opposite the prior art. In the prior art the flow-through area of each stage is allowed to float, thus allowing the flow through surface area to void volume ratio float. Preferably, the bar 14 angles, bar 14 cross section, bar 14 materials and surface properties are held constant as well during scaling. However the length to diameter ratio of the static mixer 10 according to the present invention may float, however, preferably the overall length of the static mixer 10 according to the present invention remains constant Table 1 and FIGS. 3A and 3B illustrate the effect of pipe diameter on the active surface area to void volume ratio mixers according to the prior art and for the present invention. Table 1 examines KMX type mixers, as they have a higher active surface area to void volume ratio than other types of known mixers, and thus are believed to represent the closest prior art. These data are graphically represented in FIG. 3A. These data are based on pipes of circular cross section. Of course, any cross section having a reasonable hydraulic radius may be utilized.

TABLE 1

| Suppliers of Prior Art Static Mixers | Diameter (mm) | Prior Art Active Surface Area to Void Volume Ratio (l/mm) | Present Invention Active Surface Area to Void Volume Ratio (l/mm) |
|---|---|---|---|
| Chemineer, Inc. (Kenics KMX style) | 3 | 6.28 | 6.28 |
| Chemineer, Inc. (Kenics KMX style) | 4 | 4.07 | 6.28 |
| Chemineer, Inc. (Kenics KMX style) | 6 | 3.75 | 6.28 |
| Chemineer, Inc. (Kenics KMX style) | 8 | 2.65 | 6.28 |
| Chemineer, Inc. (Kenics KMX style) | 10 | 2.46 | 6.28 |
| Chemineer, Inc. (Kenics KMX style) | 12.52 | 1.91 | 6.28 |
| Chemineer, Inc. (Kenics KMX style). | 15.8 | 1.17 | 6.28 |
| Chemineer, Inc. (Kenics KMX style) | 20.9 | 0.87 | 6.28 |
| Chemineer, Inc. (Kenics KM style) and Komax Systems, Inc. (A/M Series) | 20.9 | 0.69 | 6.28 |
| Koch Glitsch, Inc. and Sulzer Chemtech Ltd. (SMX style) | 20.9 | 0.78 | 6.28 |
| Chemineer, Inc. (Kenics KMX style) | 26.6 | 0.64 | 6.28 |
| Chemineer, Inc. (Kenics KMX style) | 52.5 | 0.31 | 6.28 |
| Chemineer, Inc. (Kenics KMX style) | 62.7 | 0.25 | 6.28 |
| Chemineer, Inc. (Kenics KMX style) | 102.3 | 0.15 | 6.28 |

Referring to Line PA of FIG. 3A, it can be seen that a pilot scale static mixer 10 having a diameter of 6 millimeters was provided for the bench scale work. The pilot scale static mixer 10 was scaled to larger diameters, and is referred to as IN2 below, which was actually reduced to practice and an element 12 length, taken in the flow direction, equivalent to the diameter. Referring to Lines IN1, IN2 and IN3 of FIG. 3A, according to the present invention as the diameter of the static mixer 10 increases from the bench scale, the active surface area to void volume ratio remains constant. The active surface area to void volume ratio can be held constant at different values across the entire scale-up/scale-down range Lines IN1, IN2 and IN3 begin with a bench scale static mixers 10 having active surface area to void volume ratios comparable to prior art static mixers 10 of comparable diameter.

While FIG. 3A represents a preferred embodiment of the present invention as having a constant active surface area to void volume ratio throughout scaleup, the invention is not so limited. The active surface area to void volume ratio may increase, to any reasonable limit which does not occlude flow through the static mixer, or decrease, to the limits set forth below. However, generally the active surface area to void volume ratio may increase a greater amount above the constant ratio illustrated in FIG. 3A, if a lower active surface area to void volume ratio is used as a starting point for the scaleup.

Table 2 below illustrates the construction parameters of the prior art static mixers illustrated in Table 1, FIG. 3A and for two prophetic static mixers 10, where NR indicates that particular size static mixer 10 was not reduced to practice, because upon scaling down to that size bar 14 width could not be maintained constant and unknown properties are designated unk. The pitch between adjacent bars 14 will increase proportionate to the diameter in the prior art, and remain constant in the present invention.

wherein Y is the active surface area to void volume ratio in 1/mm and X is the total cross sectional area of the static mixer 10 in square mm.

As illiustrated in FIG. 3A, for a round cross section static mixer 10, the equation of the prior art line is Y=32.1X^−1.17 (represented by Line PA with a curve fit of R^2=0.99), so that a static mixer 10 according to the present invention satisfies the inequalities:

Y>38.6X^−1.17

Y>45.0X^−1.17, and

Y>51.4X^−1.17, wherein Y is the active surface area to void volume ratio in 1/mm and X is the diameter of the static mixer 10 in mm.

The active surface area of the static mixer 10 is found as follows. The active surface area is found as the sum of the frontal surface area, exposed directly to the flow and the thickness surface area, taken parallel to the flow direction. It will be understood by one of skill that the primary contribution to surface area comes from the frontal surface area, rather than the thickness surface area.

The frontal surface area is given by the product of the surface area of the ellipse * number of ellipses per element. The frontal surface area of the static mixer 10 bars 14 corresponds to the area of an ellipse with the minor radius (R1) equivalent to the inside diameter of the pipe (R1) and major radius (R2) equivalent to the inside diameter divided by sin Θ, where Θ is the angle between the plane of the ellipse and the longitudinal axis of the pipe (typically 45 degrees). There are two active ellipse surfaces per mixer element. The frontal surface area of the ellipse is given by: π*R1*R2.

TABLE 2

| | | Invention 2 (reduced to practice) | | | Active Surface Area to Void Volume Ratio (1/mm) | | | | Koch-Glitsch/Sulzer Chemtech SMX Prior Art Static Mixer | | |
|---|---|---|---|---|---|---|---|---|---|---|---|
| Total Cross Sectional Area (sq mm) | Diameter (mm) | Approx. Number of Elipses made by bars | Bar Width (mm) | Bar Thickness (mm) | Invention 1 (Prophetic) | Invention 2 (Reduced to Practice) | Invention 3 (Prophetic) | Kenics KMX Prior Art Static Mixer Prior Art | Number of Ellipses made by bars | Bar width (mm) | Bar thickness (mm) |
| 77 | 3 | NR | NR | NR | 1.01 | 3.38 | 6.28 | 6.28 | 2 | 0.8 | 0.32 |
| 13 | 4 | NR | NR | NR | 1.01 | 3.38 | 6.28 | 4.07 | 2 | unk | unk |
| 28 | 6 | 2 | 1 | 0.61 | 1.01 | 3.38 | 6.28 | 3.75 | 2 | 1 | 0.61 |
| 50 | 8 | 3 | 1 | 0.61 | 1.01 | 3.38 | 6.28 | 2.65 | 2 | 1.33 | 0.61 |
| 80 | 10 | 3 | 1 | 0.61 | 1.01 | 3.38 | 6.28 | 2.46 | 2 | 1.66 | 1.09 |
| 120 | 13 | 4 | 1 | 0.61 | 1.01 | 3.38 | 6.28 | 1.91 | 2 | 2.07 | 1.02 |
| 200 | 16 | 5 | 1 | 0.61 | 1.01 | 3.38 | 6.28 | 1.17 | 2 | 1.95 | 1.02 |
| 340 | 21 | 7 | 1 | 0.61 | 1.01 | 3.38 | 6.28 | 0.87 | 2 | 2.6 | 1.22 |
| 560 | 27 | 8 | 1 | 0.61 | 1.01 | 3.38 | 6.28 | 0.64 | 2 | 3.3 | 1.4 |
| 2,200 | 53 | 16 | 1 | 0.61 | 1.01 | 3.38 | 6.28 | 0.31 | 2 | 6.5 | 1.9 |
| 3,100 | 63 | 20 | 1 | 0.61 | 1.01 | 3.38 | 6.28 | 0.25 | 2 | 7.77 | 1.9 |
| 8,200 | 102 | 32 | 1 | 0.61 | 1.01 | 3.38 | 6.28 | 0.15 | 2 | 12.76 | 2.54 |

Referring to FIG. 3B, line PA represents the closest prior art known to the inventors. Lines IN25, IN50 and IN75 represent ratios 25, 50, and 75% greater than those found in the prior art.

The general equation for a static mixer 10 of any cross section according to the prior art is: Y=20.8X^−0.54, so that a static mixer 10 according to the present invention satisfies the inequalities:

Y>26.0X^−0.54 (represented by Line IN25)

Y>31.2X^−0.54 (represented by Line IN50) and

Y>36.4X^−0.54 (represented by Line IN75),

For a 45 degree, two ellipse element 12 in a round pipe, the frontal area is calculated as:

8.88*inside pipe diameter pipe (mm)^2.

The surface due to the thickness of the bars 14 in the flow direction, referred to as the thickness surface area, also has to be taken in account. For constant and equivalent bar 14 width and the same number bars 14 per element 12 this area is calculated per element 12 as: bar 14 thickness*inside diameter*number of bars 14 of that size per element 12*ratio of the bar 14 length (taken at the centerline) to the inside diameter. This latter ratio is easily found using POWERPOINT™, VISIOGRAPH™, or other CAD software as would be known by one of ordinary skill. For a 45 degree element 12 in a round pipe having four bars 14, the thickness area is calculated as the sum of 28 surfaces, i.e.:

Thickness bar 14 (mm)×Inside Diameter pipe (mm) *8*0.94+

Thickness bar 14 (mm)*Inside Diameter pipe (mm) *8*1.22+

Thickness bar 14 (mm)*Inside Diameter pipe (mm) *8*1.37+

Thickness bar 14 (mm)*Inside Diameter pipe (mm) *4*1.414.

Note the four bars 14 under consideration have 8 surfaces of various lengths and four surfaces of greater lengths, corresponding to the bar 14 surfaces touching the inside of the pipe and which do not contact the flow. Thus, the total surface area is given by the sum of the frontal and thickness surface areas.

Alternatively, the length of each edge of a bar 14 is given by the equation:

$$L=2[(D^2)-(R^2)]^{0.5}*(D/\sin\Theta)$$

wherein L is the length of the edge of the bar 14, D is the pipe diameter, R is the distance from the center of the pipe to that edge of the bar 14 and Θ remains the angle between the plane of the ellipse and the longitudinal axis of the pipe.

One of skill will recognize that the foregoing example of a KOCH-GLITSCH/SULZER CHEMTECH SMX mixer may easily be reapplied to a CHEMINEER KMX mixer by simply multiplying the calculated frontal surface area by a factor to account for the curvature of the blades in the KMX style mixer. For blades subtending a 90 degree arc, this factor is 1.11

One of skill will also recognize that either the frontal surface area or thickness surface area may make a greater contribution to the active surface area. In contrast to the foregoing example of a KOCH-GLITSCH/SULZER CHEMTECH SMX static mixer 10 having a larger frontal surface area than thickness surface area, a CHEMINEER/KENICS KM static mixer 10 has elements 12 with a relatively small frontal surface area, represented by the leading edge of the element. But such a static mixer 10 has a relatively larger thickness surface area, represented by both sides of the element 12.

The static mixer 10 void volume can be measured by filling the static mixer 10 with distilled water as known by one of ordinary skill and measuring this volume of water. The active surface area to void volume ratio is then found by simple division using these numbers.

Figure 4A:
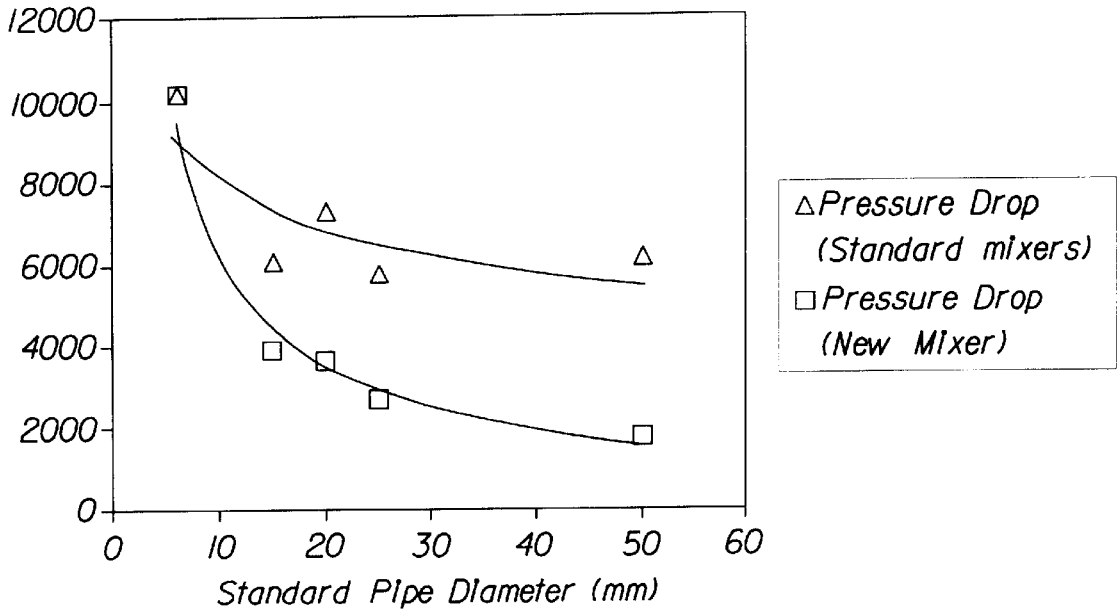
FIG. 4A is a graphical representation of static mixer performance, showing the decreased pressure drop with a static mixer according to the present invention.

FIG. 4A shows one prior art static mixer 10 according to the present invention and having an active surface area to void volume ratio of 3.38 compared to a commercially available SMX static mixer 10 made by Sulzer Chemtech Ltd. The static mixer 10 according to the present invention uses less energy, as measured by pressure drop to create an equal particle/drop size emulsion/dispersion at various pipe diameters.

FIG. 4A shows that for static mixers 10 having a flow area of at least 180 sq mm (15 mm dia.), at least 500 sq mm (25 mm dia.), or at least 960 sq mm (35 mm dia), the static mixer 10 may have a pressure drop of not more than 4000, 3000 or even 2000 (measured in any units suitable for pressure differential) for static mixers 10 up to 100 mm diameter.

Figure 4B:
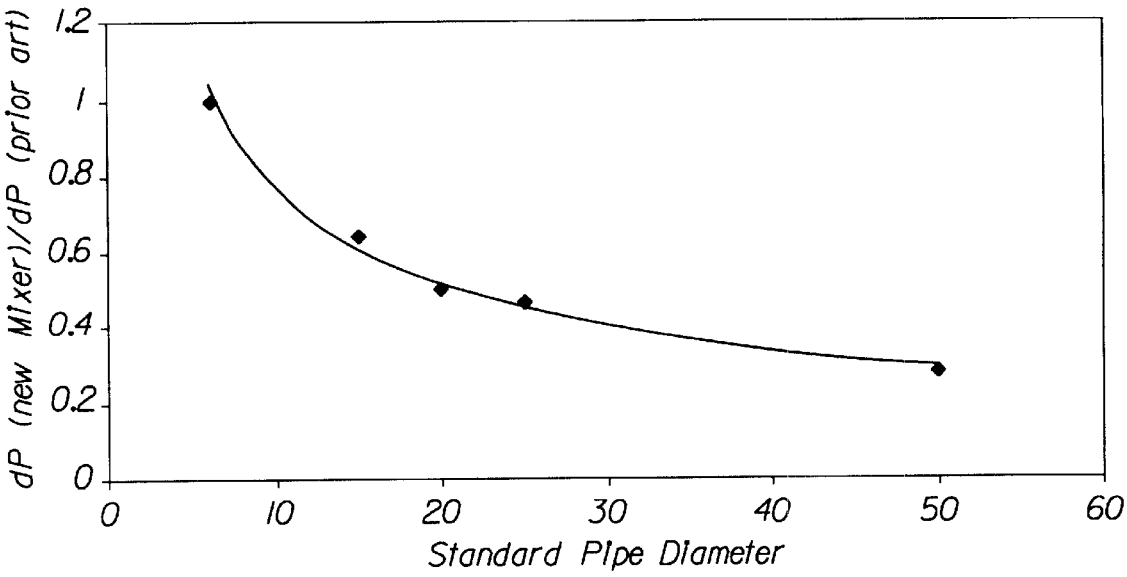
FIG. 4B is a graphical representation of the data shown in FIG. 4A, consolidated to a single curve and normalized to the prior art mixer performance.

FIG. 4B ratios the two lines in FIG. 4A to yield a single curve. FIG. 4B shows as pipe diameter, and thus cross-sectional area, increase the static mixer 10 according to the present invention provides a proportionately lower pressure drop than a static mixer 10 according to the prior art. FIG. 4B illustrates the benefits in pressure drop according to the present invention increase to the point where the present invention only requires about one-third as much energy as the prior art static mixers at large cross sectional areas.

Figure 5:
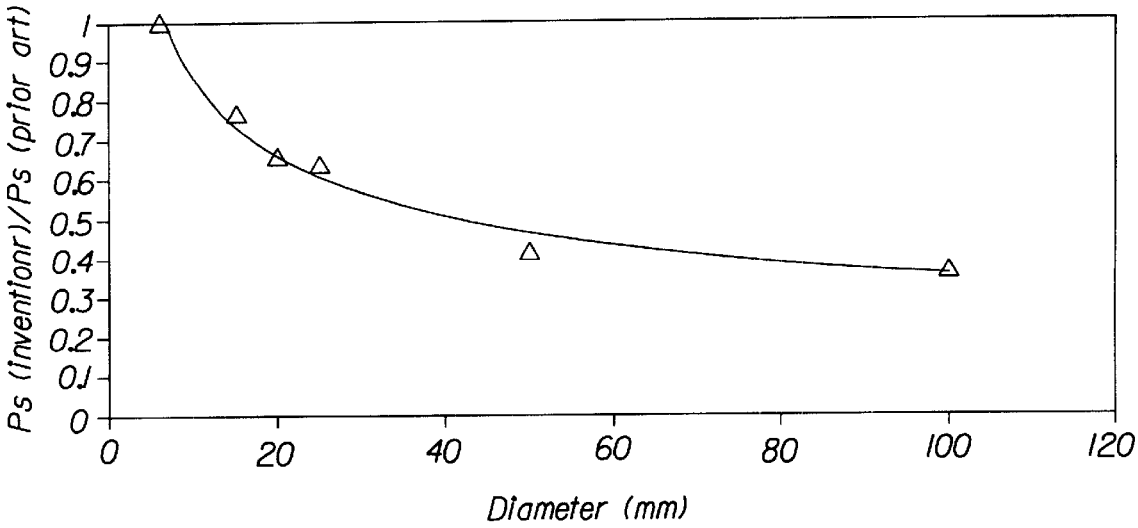
FIG. 5 is a graphical representation of static mixer performance relative to the prior art showing the improved particle size which occurs as the size of static mixer according to the present invention increases.

FIG. 5, compares the ratio of the particle size created in a static mixer 10 according to the present invention to particle size created in a prior art static mixer 10 for various diameters. By dissipating energy more effectively at equivalent total energy input (as measured by pressure drop), the present invention achieves smaller particle sizes at the same mass flow rate.

From FIG. 5 it can be seen that according to the present invention, a static mixer 10 may have a total area of 28 sq mm (6 mm dia.), 80 sq mm (10 mm dia.). For example a static mixer 10 according to the present invention having a total area of 300 sq. mm may have an active surface area to void volume ratio of at least 1.5 $mm^{-1}$, 2 $m^{-1}$, even 2.5 $mm^{-1}$ but preferably not more than about 20, 15, or even about 10 $mm^{-1}$.

Several variations in the static mixer 10 according to the present invention are feasible. For example, the conduit diameter, or other cross sectional shape, may be varied in order to vary flow rate locally within the conduit relative to the mixing element. Such cross-sectional variability along the axis can be used to increase shear (smaller cross section), decrease shear (increased cross section), or to cycle shear rates (repeated increasing and decreasing cross sections) along the length of the mixer. For example, in addition to having multiple static mixers 10 and/or stages with varying cross sections as discussed above (systems comprising two or more static mixers 10 and/or stages are also considered to be within the scope of the present invention), such variation can be provided by providing a conduit wherein conduit cross sectional dimensions vary as a function of conduit length.

Alternatively, the static mixer 10 of the present invention may have constant cross sectional area and an increasing number of elements, bars 14, bar 14 angle, and decreasing bar 14 width (e.g. by increased bar 14 count) to effect greater shear in the flow direction. For example the first stage of the static mixer 10 may have two bars 14, the second stage three or more bars 14, etc. In a variation, the bars 14 of the static mixer 10 may be notched to overlap adjacent bars 14. This arrangement increases the active surface area to void volume ratio.

Also the bar 14 count, angle and size may be scaled by increasing the individual bar 14 count with bars 14 of decreasing width and length placed at an increased angle to the axis along the conduit to provide a continuous increase in shear. In yet another embodiment of the static mixer 10, individual bars 14 may be connected end to end so that each stage may be rotated relative to the other to provide a static mixer 10 with adjustable shear along its length by being able to angularly adjust each stage relative to the other to provide adjustable rotationally oriented shear in the transition from one stage to the others. The ends of each stage may be further connected with threaded fittings with O-ring seals so as to allow for adjustment of axial separation in the flow direction between elements 12 as well as rotational orientation. Such a configuration allows for adjustment during use by a control system sensing viscosity, droplet size, or flow rate.

Combinations of stages having varying degrees of applied shear as described above allows some of the advantages of a dynamic mixer in a much simpler static mixer. For example, shear rates can be adjusted to vary the uniform droplet size being produced or the uniformity of the droplet size over time and length. Also, if needed, localized (internal) re-circulating flow can be designed into the mixer via the use of curved mixing elements 12 that impart counter flow. However, it is preferred that the static mixer 10 according to the present invention maintain constant bar 14 width, and preferably constant bar 14 thickness during scale up, so that local flow conditions near the bars 14 are matched as closely as possible in the commercial sized and bench scale static mixers.

Using multiple injection points, the static mixer 10 can be customized to provide bimodal, trimodal, etc. particle size distributions, by first injecting the materials to be dispersed into the smallest particle size, next injecting the material to give a larger particle size, etc. Multiple injection points can also be sued to provide multiple emulsions, useful for controlled delivery rates in various drugs.

Multiple static mixers may be disposed in parallel (including annular configurations) to provide for increased throughput. For example, two static mixers designed to provide different amounts of shear, so as to provide a first emulsion having differing droplet sizes formed continuously in a predetermined relationship with a second emulsion, may be used. Alternatively, the cross sectional area of a particular element 12 may be tapered to gradually increase or decrease in the flow direction.

POTENTIAL APPLICATIONS

Exemplary, non-limiting uses of static mixers include making high internal phase emulsions (HIPE), as exemplified by U.S. Pat. Nos. 3,946,994 issued Mar. 30, 1976 to Mertz et al. and 4,844,620 issued Jul. 4, 1989 to Lissant. HIPE can be used to make foam absorbent materials (FAM). FAM may be used as the core in baby diapers, sanitary napkins, etc. where absorption of liquids is desired, as illustrated by commonly assigned U.S. Pat. No. 5,268,224 issued Dec. 7, 1993 and incorporated herein by reference.

The static mixer 10 may be installed close to the end use of the mixture. For example a static mixer 10 may be mounted in a vehicle (i.e. automobile, truck, airplane etc.) so that a water-gasoline or water-diesel emulsions may be formed right before the combustion chamber. The static mixer 10 may be incorporated into a gasoline pump nozzle so that a water-gasoline emulsion may be formed at the point of filling the gasoline or diesel fuel. The static mixer 10 of the present invention may also be used to produce gas dispersions in viscous materials such as polymers as illustrated by U.S. Pat. No. 5,861,474 issued to Weller J. P. et al. on Jan. 19, 1999. For example, the static mixer 10 of the present invention may be used, for example, to disperse water into gasoline materials and other hydrocarbons to produce an emulsion with improved safety (reduced volatility, leakage due to higher viscosity), improved combustion efficacy (reduced NOx, CO, lower particulate emissions). Water in oil fuel mixtures are discussed in WO 01/36569 published May 25, 2001 in the names of Schulz et al. The static mixer 10 may also be used to disperse water into crude oil during drilling and recovery operations reliably forming emulsions at large scales of operation or in refineries where dispersion properties are critical to oil recovery operations such as alkylations or caustic washes.

In another embodiment of the present invention, the static mixer 10 of the present invention may be used to produce in-line emulsions for food products (i.e. mayonnaise, creams, spreads, cheese, etc.) reliably at large range of scales of operation. In another embodiment of the present invention, the static mixer 10 of the present invention may be used to produce emulsions for cosmetic or medical application, for example drug delivery via syringe, topical creams, tooth filling materials etc. This invention may be miniaturized and installed in a close proximity to the end use, permitting physically/chemically reactive or incompatible phases to be in contact only at the point of delivery). An individual dosage of medication may be mixed at the point of use by placing the static mixer 10 in the reservoir of a hypodermic syringe.

The static mixer 10 of the present invention may be used to produce emulsions for papermaking applications, e.g. applying ink emulsions to paper, or for applying creams to non-woven substrates, etc. The static mixer 10 can also be used where the emulsion is further processed such as by injection molding, casting, extrusion, and similar applications, where quick changeovers among different formulations and/or start/stop procedures are required and where changes are needed to the mixing characteristics due to the change in formulation.

What is claimed is:

1. A static mixer having a predetermined number of elements and predetermined number of discrete bars in each element, said static mixer having a total cross sectional area of at least 300 sq mm and satisfying the inequality $Y>26.0X^{\wedge}-0.54$, wherein Y is the active surface area to void volume ratio in 1/mm and X is the total cross sectional area in square mm of said static mixer.

2. A static mixer according to claim 1 satisfying the inequality $Y>31.2X^{\wedge}-0.54$.

3. A static mixer according to claim 2 satisfying the inequality $Y>36.4X^{\wedge}-0.54$.

4. A static mixer according to claim 1 having a longitudinal axis in the flow direction and a predetermined cross sectional area, said predetermined cross sectional area varying at two different positions on said longitudinal axis.

5. A static mixer according to claim 4 having an element with a tapered cross section.

6. A static mixer according to claim 1 having a longitudinal axis in the flow direction and a predetermined cross sectional area, said static mixer having a plurality of bars, each said bar being disposed at an angle relative to the longitudinal direction, said angle being adjustable relative to said longitudinal axis.

7. A static mixer according to claim 1 having a longitudinal axis in the flow direction and a predetermined cross sectional area, said static mixer having at least two elements, a first element and a second element disposed downstream therefrom in the flow direction, each said element comprising a plurality of bars, said second element having a different number of bars than said first element.

8. A static mixer having a predetermined number of elements and predetermined number of discrete bars in each element, each element having a predetermined cross sectional area, said cross sectional area of at least one element being greater than 300 sq mm, said static mixer further comprising an active surface area, void volume and perimeter, said perimeter having a predetermined size and shape, said active surface area and said void volume defining an active surface area to void volume ratio, said ratio being greater than 1.5.

9. A static mixer according to claim 8 wherein said ratio is greater than 2.

10. A static mixer according to claim 8 having a longitudinal axis in the flow direction and a predetermined cross sectional area, said predetermined cross sectional area varying at two different positions on said longitudinal axis.

11. A static mixer according to claim 10 having an element with a tapered cross section.

12. A static mixer according to claim 8 having a longitudinal axis in the flow direction and a predetermined cross sectional area, said static mixer having a plurality of bars, each said bar being disposed at an angle relative to the longitudinal direction, said angle being adjustable relative to said longitudinal axis.

13. A static mixer according to claim 8 having a longitudinal axis in the flow direction and a predetermined cross sectional area, said static mixer having at least two elements, a first element and a second element disposed downstream therefrom in the flow direction, each said element comprising a plurality of bars, said second element having a different number of bars than said first element.

14. A static mixer according to claim 13 wherein said second element has a greater number of bars than said first element.

* * * * *